United States Patent [19]

Ikawa et al.

[11] 4,099,994

[45] Jul. 11, 1978

[54] HIGH DUTY DUCTILE CASE IRON AND ITS HEAT TREATMENT METHOD

[75] Inventors: Katsuya Ikawa; Yuichi Tanaka, both of Muroran, Japan

[73] Assignee: Riken Piston Ring Industrial Co. Ltd., Tokyo, Japan

[21] Appl. No.: 814,800

[22] Filed: Jul. 11, 1977

Related U.S. Application Data

[63] Continuation of Ser. No. 678,480, Apr. 20, 1976, abandoned.

[30] Foreign Application Priority Data

Apr. 22, 1975 [JP] Japan ..... 50-48767

[51] Int. Cl.[2] ..... C21D 5/00

[52] U.S. Cl. ..... 148/35; 148/139

[58] Field of Search ..... 148/138, 139, 140, 35, 148/12 C; 75/123 CB, 130 R

[56] References Cited

U.S. PATENT DOCUMENTS

| | | | |
|---|---|---|---|
| 2,835,619 | 5/1958 | Millis et al. | 148/139 |
| 2,887,421 | 5/1959 | Peras | 148/139 |
| 3,155,498 | 11/1964 | Jandras | 148/138 |
| 3,607,458 | 9/1971 | Hunsaker et al. | 148/139 |

*Primary Examiner*—M. J. Andrews

[57] ABSTRACT

A ductile cast iron having a high tensile strength as well as a high elongation due to its matrix structure of finely mixed ferrite and pearlite grains obtained by the heat treatment. The material is pearlitic ductile cast iron and may be of ordinary ductile cast iron composition with the only exception that the manganese content being substantially less than 1%.

A method of heat treatment for obtaining such a ductile cast iron, which is composed substantially of heating the material rapidly to form ferrite, austenite and graphite co-existing structure, and air cooling the same to change that structure into the above mentioned matrix structure.

3 Claims, 12 Drawing Figures

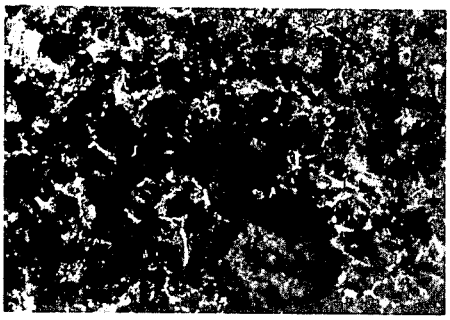
FIG. 2 (x225)
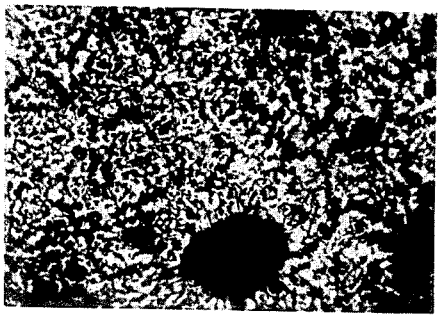
FIG. 3 (x225)
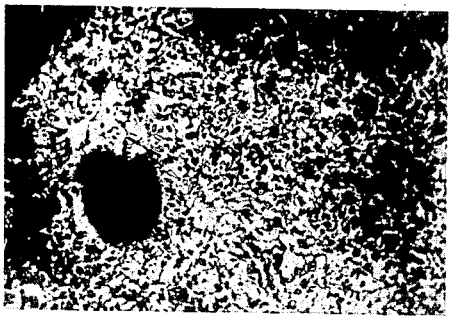
FIG. 4 (x225)
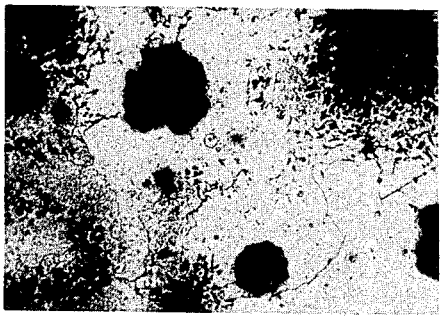
FIG. 5 (x225)
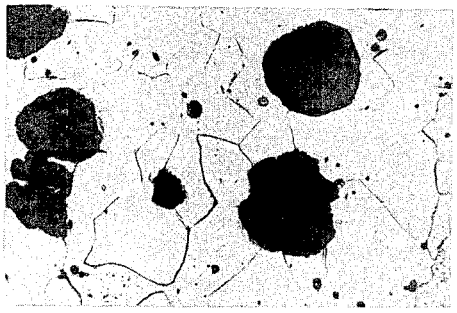
FIG. 6 (x225)

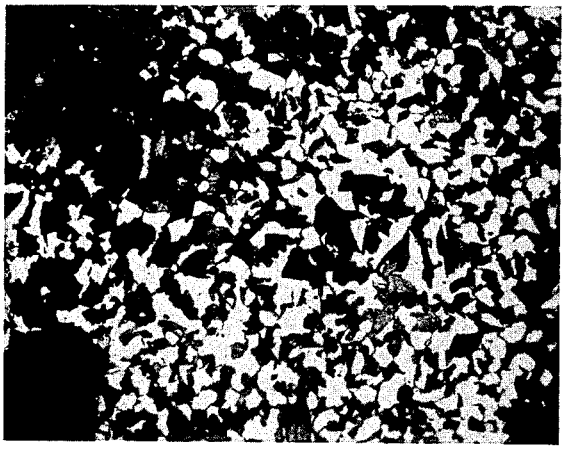
FIG.10 (x400)
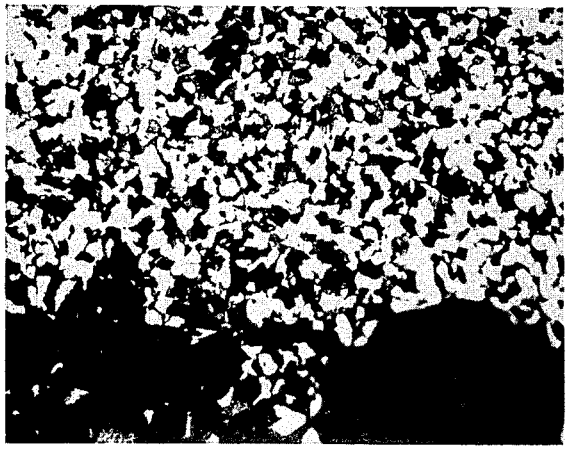
FIG.11 (x400)

HIGH DUTY DUCTILE CASE IRON AND ITS HEAT TREATMENT METHOD

This is a continuation of Application Ser. No. 678,480, filed Apr. 20, 1976, now abandoned and photomicrographs filed Jan. 28, 1977.

BACKGROUND OF THE INVENTION

The present invention relates to improvements in ductile cast iron and its heat treatment.

The strength of cast iron has been improved remarkably by the development of spheroidal graphite cast iron, i.e. ductile cast iron, but its ductility and impact resistance are still behind those of the steel.

To improve these mechanical properties, several attempts such as refining of the graphite nodules of the alloying of special elements have been made, but not succeeded yet in obtaining sufficient results, besides, these processes may have such disadvantages as requiring of special melting proesses or expensive raw materials.

We have presented in our previous U.S. patent application Ser. No. 583,877, a specific ductile cast iron and its heat treatment method, which may improve such disadvantages as mentioned above.

However, its heat treatment process is rather complicated and may have some disadvantages of requiring special equipments.

Namely, that ductile cast iron of high tensile strength and elongation presented previously is characterized by a fine grained matrix structure having very fine cementite particles dispersed in ferrite grains, and is obtained by an application of 6–10 times repeated thermal cycles each composed of rapid heating to the austenite temperature range and air cooling from that temperature range.

Therefore, operation is somewhat complicated and heat treating bath of such as molten salt, lead or aluminum is required for performance.

SUMMARY OF THE INVENTION

Accordingly, an object of the present invention is to provide a ductile cast iron having the desired properties and a specific microstructure, and another object is to provide method of obtaining such ductile cast iron.

We have found that the above and related objects may be readily attained in a ductile cast iron having a microstructure wherein the graphite nodules being deposited in a matrix structure of finely mixed ferrite and pearlite grains.

The ductile cast iron may be made from ordinary ductile cast iron composition with the only exception that the manganese content being substantially less than 1%, as recommended in our previous invention. The ductile cast iron according to the present invention shows as high tensile strength and elongation as comparable to those of our previous invention.

We have found that such a ductile cast iron may be obtained by heating pearlitic ductile cast iron (hereinafter sometimes referred to as "the material") to a temperature range in which ferrite, austenite and graphite co-existing structure is formed, and air cooling the same to change that structure into the above mentioned microstructure wherein the graphite nodules are deposited in a matrix structure of finely mixed ferrite and pearlite grains.

As a result of our various studies on the quality improvements of ductile cast iron, we have succeeded in obtaining such ductile cast iron of strong and high elongation, by air cooling the material having chemical composition of 3.0–4.0%C, 1.5–2.5%Si, less than 1.0%Mn, max. 0.1%P and max. 0.02%S, which is of ordinary ductile cast iron, from ferrite ($\alpha$), austenite ($\gamma$) and graphite (G) co-existing structure, and found that its microstructure is composed substantially of matrix structure of finely mixed ferrite and pearlite grains. Thus obtained samples showed 72–83 Kg/mm$^2$ tensile strength and 7–10% elongation which are comparable to those of our previous invention.

Chemical composition of the material may be of ordinary ductile cast iron as set forth above, but manganese content should be substantially less than 1.0%, otherwise, martensite may be formed by air cooling which causes brittleness of the material.

Magnesium may be included in the material for about 0.035 – 0.06%, when magnesium or magnesium alloy is used for spheroidizing of graphite.

Principle of operation of the present invention may be explained with reference to the Fe—C—Si ternary equilibrium diagram as follows:

In FIG. 1 is shown a sectional diagram of Fe—C—Si ternary metastable system sectioned at 3.8%-Si, of which vertical and horizontal axes indicate temperature ° C and C% respectively.

In the figure, letters $\alpha$, $\gamma$ and $\delta$ represent respective phases, L is liquid, Z is cementite, and area of the respective phases are indicated in connection with temperature and C%, as is well known. In the figure, area represented by $\alpha+\gamma+Z$ indicates a range in which ferrite, austenite and cementite are co-existing and so called eutectoid range.

Similar sectional diagram is also considered duly with Fe—C—Si stable system, in which cementite is replaced with graphite, but actual diagram of this stable system is not known yet, so that, hereinafter, in the explanation of stable system, cementite (Z) will be read as graphite (G) in FIG. 1.

In the structure of cast iron, in general, ferrite ($\alpha$), pearlite ($\alpha+Z$) and graphite (G) co-exist, so that both iron-graphite stable system and iron-cementite metastable system should hold at the same time according to the phase rule.

Therefore, when a cast iron of the structure wherein the graphite nodules are deposited in the pearlite matrix, is held at temperature of the above mentioned eutectoid range, a part of pearlite ($\alpha+Z$) changes to austenite ($\gamma$), and a co-existing structure ($\alpha+\gamma+Z+G$) may be formed, but, at the same time, graphitization takes place according to the stable diagram, and pearlite ($\alpha+Z$) is changed to ($\alpha+G$), and thus produced graphite is absorbed within the already existing graphite and, as a result, cementite (Z) disappears and ferrite and austenite remain in the matrix.

The present invention utilizes above mentioned two metallographical phenomena, i.e., the process is composed of heating the cast iron material of pearlitic matrix structure to the temperature range of ($\alpha+\gamma+G$) structure before cooling. In this case, heating is preferably made rapidly so that the austenitization takes place finely all over the matrix. It is also desirable to have a greater amount of pearlite in the starting structure, because, formation of austenite nuclei takes place at the phase boundaries of cementite and ferrite in the pearlite matrix.

Cast iron of thus obtained ferrite + austenite + graphite structure is then air cooled, and thus the matrix structure of finely mixed ferrite and pearlite grains with the graphite nodules deposited therein, is obtained at the room temperature.

Accordingly, air cooling temperature in the process of the present invention is not limited only to the eutectoid range in the diagram, but also may extend to higher temperature than that range, because it is only important to heat the material to ferrite, austenite and graphite co-existing structure.

These and other objects and advantages of the invention may be made apparent from the following description, claims and the accompanying drawings.

BRIEF DESCRIPTION OF THE DRAWINGS

FIG. 2, FIG. 3, FIG. 4, FIG. 5 and FIG. 6 are photographs of microstructure (225 magnification) taken with the material of the present invention, each being air cooled from 810° C, 790° C, 780° C, 765° C and 700° C, respectively; and particularly, FIG. 3 and FIG. 4 are photo-graphs of typical structure of ductile cast iron according to the present invention; and FIG. 2, FIG. 5, and FIG. 6 are photographs of undesirable structures;

FIG. 10 is a photograph showing structure of another example of the present invention (400 magnification);

FIG. 11 is a photograph of sample of the present invention having the same chemical composition as of FIG. 10, but subject to a different heating process before air cooling.

DESCRIPTION OF THE PREFERRED EMBODIMENTS

EXAMPLE 1

Figure 1:
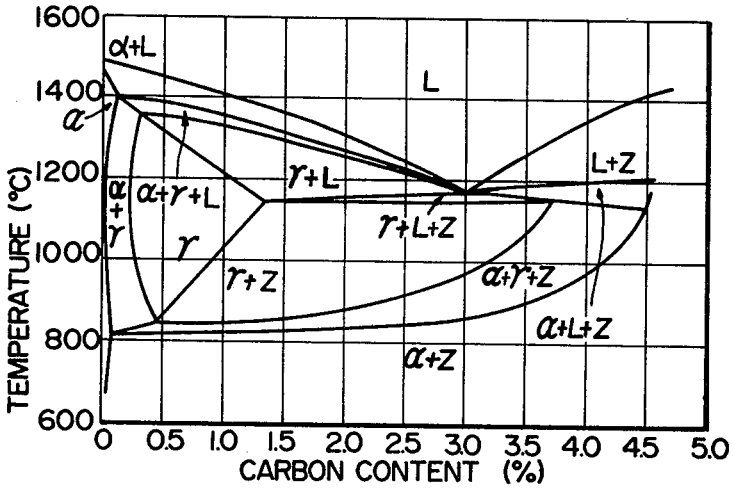
FIG. 1 shows a sectional diagram of Fe—C—Si ternary system sectioned at 3.8% Si.

Samples of ductile cast iron, each marked with MO6, MO7, M32, M56 and M96, were prepared by the usual melting process, of which chemical composition is as shown in Table 1.

Table 1

| Sample No. | Chemical Composition (wt. %) | | | | | |
|---|---|---|---|---|---|---|
| | C | Si | Mn | P | S | Mg |
| M06 | 3.77 | 1.71 | 0.06 | 0.017 | 0.010 | 0.051 |
| M07 | 3.58 | 2.54 | 0.07 | 0.016 | 0.011 | 0.036 |
| M32 | 3.41 | 2.19 | 0.32 | 0.033 | 0.010 | 0.054 |
| M56 | 3.41 | 2.10 | 0.56 | 0.034 | 0.010 | 0.053 |
| M96 | 3.41 | 2.10 | 0.96 | 0.035 | 0.010 | 0.055 |

The phosphorous and sulfur contents of the above table are attendant impurities as known in the art, and respective maximum contents of 0.1 percent and 0.02 percent, respectively, give no adverse affect on the desired properties of the resulting products.

These samples are of ordinary ductile cast iron composition, but with varied manganese content except for MO6, of which manganese content is almost equal to MO7 but having smaller silicon content of 1.71%.

Samples were cast to the mold of "Y"-block (JIS G5502, Spheroidal Graphite Iron Castings Type A, which is similar to ASTM Designation: A 536-72, Thickness 1-in.)

Specimens of 12 × 12 × 75 mm size were machined from each sample castings, and normalized by heating at 880° C for 1 hr., followed by air cooling.

Samples were preheated at 550° C for 10 min. so as to be able to heat to the air cooling temperature rapidly.

Samples were heated to various testing temperature at the rate of 20° – 40° C/min., held for 2 hrs., and thereafter air cooled, and structure was inspected with each sample.

Heating temperatures, by air cooling from which the matrix having mixed structure of ferrite and pearlite grains were obtained, are shown below with each sample.

| Sample No. | Heating Temperature |
|---|---|
| M06 | 780° C, 785° C |
| M07 | 805° C, 810° C |
| M32 | 805° C, 810° C |
| M56 | 780° C, 790° C |
| M96 | 780° C, 790° C |

Microstructures of sample M56 are shown in FIG. 2 through FIG. 6, wherein FIG. 2, FIG. 5, and FIG. 6 show structures obtained by heat treatment under temperatures outside of the preferred range, for example:

FIG. 2 shows a structure obtained by heating at 810° C a higher temperature than the preferred range for 2 hrs. followed by air cooling. Matrix structure, in which spheroidal graphite nodules are deposited, is mostly of pearlite, indicating that most of the original pearlitic structure have changed to austenite during the heating process and then transformed back to pearlitic structure by air cooling.

FIG. 3 shows a structure obtained by heating at 790° C followed by air cooling. In this case, the temperature is within the eutectoid (alpha + gamma + G coexisting temperature) range, so that about 50 percent of the starting matrix changes to ferrite and this austenitization took place finely due to rapid heating. The austenite changes to pearlite by the air cooling, whereas the ferrite remains unchanged. Thus a matrix structure of finely mixed pearlite and ferrite (shown in white grains) were obtained at room temperature.

FIG. 4 shows a structure obtained by heating at 780° C followed by air cooling. Austenitization proceeds not so much as in the above case, so that amount of ferrite is increased.

And manganese segregates at portions spaced from the graphite nodules, and as the manganese lowers the eutectoid temperature, portions around the graphite nodules correspond to lower part in the eutectoid temperature range, and portions apart from the graphite nodules correspond to higher part therein when the sample is heated to that temperature, therefore, amount of ferrite being increased in the former portions and amount of austenite, that becomes pearlite at room temperature, being increased in the latter portions.

Structures shown in FIG. 3 or FIG. 4 are the typical structure of ductile cast iron according to the present invention.

Structure shown in FIG. 5 was obtained by heating the sample at 765° C a lower temperature than the preferred range followed by air cooling. In this case, similar phenomena as shown in FIG. 4 appear more severely, and large ferrite grains are observed around the graphite nodules.

FIG. 6 shows a structure obtained by heating the sample at 700° C followed by air cooling. Co-existing structure of ferrite, austenite and graphite was not attained at this temperature, so that all of the pearlite in the starting structure changed to the structure of graphite and ferrite according to the stable Fe-C diagram.

As for the mechanical properties of these samples, samples of finely mixed structure of ferrite and pearlite grains as shown in FIG. 3 and FIG. 4 showed remarkably high elongation of 9 – 10% even with high tensile strength of 73 – 78 Kg/mm$^2$, whereas, samples of pearlitic structure as shown in FIG. 2 showed a high tensile strength of 90 – 100 Kg/mm$^2$ but low elongation of 3 – 5%.

Nextly, samples shown below were heated to and held for the corresponding temperature and time, respectively indicated, and thereafter air cooled.

| Sample No. | Temperature (° C) | Holding Time (hrs.) |
|---|---|---|
| M06 | 780 | 2 |
| M07 | 805 | 2 |
| M32 | 805 | 2 |
| M56 | 790 | 8 |
| M96 | 782 | 12 |

Figure 7:
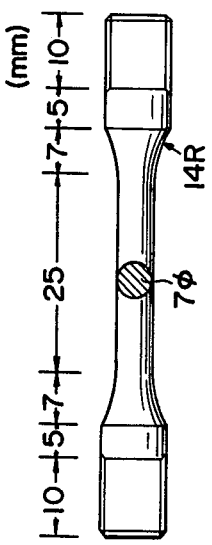
FIG. 7 is a drawing of tensile test specimen.

Tensile test specimens as shown in FIG. 7 were then machined from each sample and tensile test was performed using the Instron type tensile testing machine with a pulling speed of 0.5 mm/min.

Figure 8:
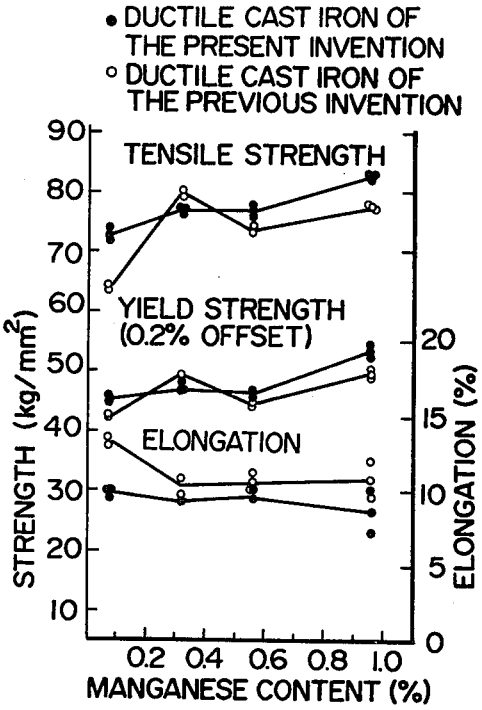
FIG. 8 is a graph showing tensile test results of ductile cast iron according to the present invention.

FIG. 8 shows thus obtained tensile and yield strength values in connection with manganese content of samples. Similar values obtained with samples of fine pearlitic matrix structure according to our previous invention are also given in the figure for comparison.

As is apparent from the figure, tensile and yield strength increase with the increase of manganese content, but elongation decreases.

As compared to the ductile cast iron of fine pearlitic matrix structure according to our previous invention, our present ductile cast iron is slightly higher or equal in tensile and yield strength, and slightly lower or equal in elongation.

Figure 9:
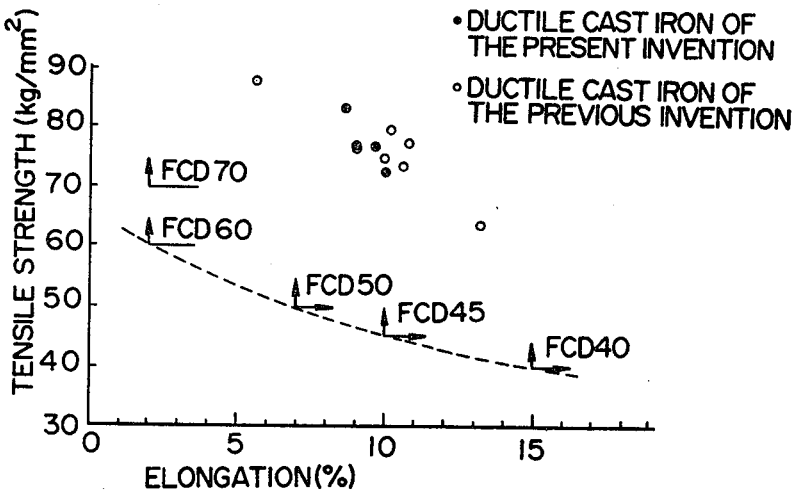
FIG. 9 is a graph showing similar tensile test results in comparison with the requirements specified in JIS (Japan Industrial Standard) G5502 Spheroidal Graphite Iron Casings.

Relations between tensile strength and elongation of these samples are shown in FIG. 9 in comparison with ranges of JIS requirements. In the figure, FCD 60, for example, represents ductile cast iron of tensile strength 60 kg/mm$^2$, minimum.

It is apparent from the figure, that the ductile cast iron of our present invention, as well as of our previous invention, not only conforms but is also far superior to the JIS requirements, and our ductile cast iron has a remarkably high elongation value at equal or higher tensile strength, when compared to the conventional ductile cast iron.

EXAMPLE 2

We have inspected, further, the effect of heating process to the heat treatment temperature on the grain size of matrix by comparing structures.

FIG. 10 shows a structure of sample M32, which has been normalized as in Example 1, and was heated to 850° C which is within an austenite and graphite two-phase co-existing temperature range, held for 30 min., then furnace cooled to 805° C and held for 1.5 hr., and thereafter air cooled.

FIG. 11 shows a structure of sample M32, which is of same chemical composition and previously normalized as in FIG. 10, but heated directly to 805° C from room temperature and held for 2 hrs., and thereafter air cooled.

FIG. 10 and FIG. 11 show a matrix structure having two phases of ferrite and pearlite grains both in a finely mixed state.

However, inspecting of grain size more precisely by means of so called "Intercept method" revealed that the size in FIG. 10 is 6.1 microns, and that in FIG. 11 is 4.4 microns, and is showing that the direct heating is better for obtaining finer two phase mixed matrix structure.

Figure 12:
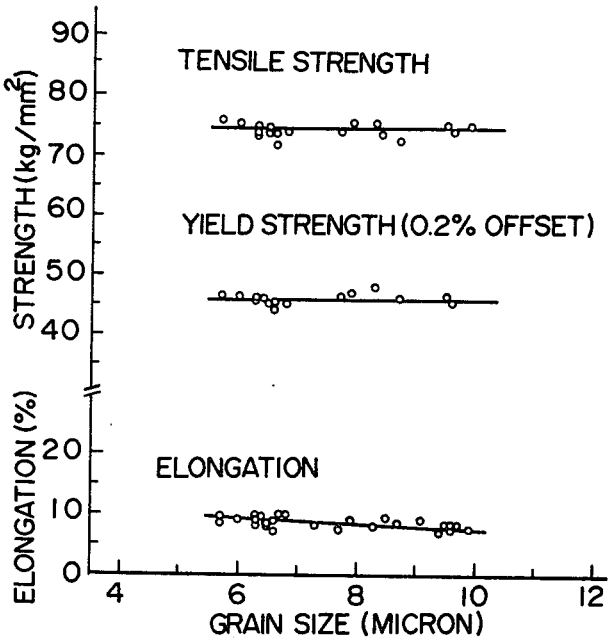
FIG. 12 is a graph showing variations of mechanical properties with grain size obtained by different heating processes before air cooling.

FIG. 12 shows variations of the mechanical properties with grain size. The graph was obtained with samples M32, first heated at 850° C for 30 minutes, then furnace cooled to 805° C and held for various times from 1 to 166 hrs., and thereafter air cooled. Grain size of 5.7 – 9.9 microns were obtained. In this case, grain growth was proportional to $\frac{1}{3}$ power of holding time at 805° C.

As shown in FIG. 12, tensile and yield strength are about 75 Kg/mm$^2$ and 46 Kg/mm$^2$, respectively, and almost constant regardless of grain growth, however, elongation decreases from 9.5% to 7.5% with the increase of grain size.

Results shown in FIG. 12 mostly conform to those shown in FIG. 8 of Example 1, and it is apparent that, in either heating process, ductile cast iron of the present invention shows remarkably high elongation values at about the same degree of high tensile strength, when compared to the conventional high duty ductile cast iron. And the material which is previously normalized, may be directly heated to the temperature range in which ferrite, austenite and graphite co-existing structure is formed, or may be heated to a higher temperature than said temperature range and furnace cooled to attain the specific structure.

Further, it will be understood, that the similar results may be obtained by heating the material rapidly to a higher temperature than that of $\alpha$-$\gamma$-G co-existing structure and air cooling during the stage where the structure of ferrite, austenite and graphite is still remaining, on the way of changing structure from graphite and pearlite to graphite and austenite shown in FIG. 1.

As aforementioned, ductile cast iron according to the present invention has not only excellent tensile and yield strength but also remarkably high elongation value in spite of its ordinary chemical composition because of its finely mixed matrix structure of ferrite and pearlite grains with the graphite nodules deposited in said matrix. As for the only exception, manganese content of the material should be substantially less than 1% to prevent formation of martensite in case of air cooling, which may cause brittleness of the material.

Ductile cast iron of the present invention can be produced easily and inexpensively, because, excellent properties being obtained by a simple heat treatment process without requiring any special heat treating equipments.

By the heat treatment process according to the present invention, we can afford excellent properties to the above mentioned ordinary material due to its quality improving ability. The process is very simple, so that has a high reliability and does not require any special equipments, because it is composed of only heating the material to a predetermined temperature and air cooling process.

While ductile cast iron herein described, and methods of obtaining thereof, constitute preferred embodiments of the invention, it is to be understood that the invention is not limited to these particular methods and materials, but changes may be made in either without departing from the scope of the invention.

What is claimed is:

1. A ductile cast iron having a tensile strength of at least 72 kg/mm$^2$ and an elongation of at least 7%, consisting essentially of 3.0 - 4.0% C, 1.5 - 2.5% Si, less than 1.0% Mn, no more than 0.1% P, no more than 0.02% S and the balance Fe, and further having a microstructure wherein the graphite nodules are deposited in a matrix structure of finely mixed ferrite and pearlite grains of a size less than 10 microns, said microstructure being obtained by cooling the ductile cast iron of said chemical composition from a temperature range between 780° and 810° C in which a ferrite, austenite, and graphite coexisting structure is formed.

2. A method of heat treatment to obtain a ductile cast iron having a tensile strength of at least 72 kg/mm$^2$ and an elongation of at least 7%, and having a microstructure in which graphite nodules are deposited in a matrix structure of finely mixed ferrite and pearlite grains of a size less than 10 microns, comprising the steps of:

heating a pearlitic ductile cast iron material consisting essentially of 3.0 - 4.0% C, 1.5 - 2.5% Si, less than 1.0% Mn, no more than 0.1% P, no more than 0.02% S, and the balance Fe, to a strictly controlled temperature range selected on the basis of the chemical composition of said material and being in the range from 780° to 810° C in which a ferrite, austenite and graphite coexisting structure is formed; and subsequently air-cooling from that temperature.

3. A method of heat treatment to obtain a ductile cast iron having a tensile strength of at least 72 kg/mm$^2$ and an elongation of at least 7%, and having a microstructure in which the graphite nodules are deposited in a matrix structure of finely mixed ferrite and pearlite grains of a size less than 10 microns, comprising the steps of:

heating a pearlitic ductile cast iron material consisting essentially of 3.0 - 4.0% C, 1.5 - 2.5% Si, less than 1.0 Mn, no more than 0.1% P, no more than 0.02% S, and the balance Fe, to an austenite temperature range;

furnace cooling said material from said temperature range to a strictly controlled temperature range selected on the basis of the chemical composition of said material and being in the range from 780° to 810° C in which a ferrite, austenite and graphite coexisting structure is formed:

holding said temperature range for a sufficient time for complete formation of said structure; and subsequently air-cooling the material.

* * * * *